United States Patent [19]

Dassler et al.

[11] Patent Number: 4,648,187

[45] Date of Patent: Mar. 10, 1987

[54] ATHLETIC SHOE SOLE WITH CLEATS HAVING THREADED EXCHANGEABLE GRIPPING ELEMENTS

[75] Inventors: Armin A. Dassler; Willi Bauer, both of Herzenogenaurach, Fed. Rep. of Germany

[73] Assignee: Puma AG Rudolf Dassler Sport, Fed. Rep. of Germany

[21] Appl. No.: 756,250

[22] Filed: Jul. 18, 1985

[30] Foreign Application Priority Data

Jul. 19, 1984 [DE] Fed. Rep. of Germany ..... 3426601

[51] Int. Cl.[4] ..... A43C 15/16

[52] U.S. Cl. ..... 36/134; 36/65; 36/67 D

[58] Field of Search ..... 36/114, 134, 59 R, 62, 36/65, 67 D, 67 A

[56] References Cited

U.S. PATENT DOCUMENTS

| | | | |
|---|---|---|---|
| 2,222,650 | 11/1940 | Brady | 36/67 D X |
| 2,223,794 | 12/1940 | Pierce et al. | 36/67 D |
| 2,302,471 | 11/1942 | Pierce et al. | 36/59 R |
| 3,911,600 | 10/1975 | Dassler | 36/67 D |
| 4,193,216 | 3/1980 | Ueda | 36/67 D |
| 4,357,763 | 11/1982 | Fleischmann et al. | 36/134 X |
| 4,366,632 | 1/1983 | Bente | 36/67 D |
| 4,445,289 | 5/1984 | Beneteau | 36/134 |
| 4,492,047 | 1/1985 | Arff | 36/134 |
| 4,527,344 | 7/1985 | Mozena | 36/134 X |

FOREIGN PATENT DOCUMENTS

| | | | |
|---|---|---|---|
| 1888123 | 12/1963 | Fed. Rep. of Germany . | |
| 2542116 | 3/1977 | Fed. Rep. of Germany | 36/67 D |
| 2409023 | 6/1979 | France . | |
| 2098457 | 11/1982 | United Kingdom | 36/134 |

*Primary Examiner*—Werner H. Schroeder
*Assistant Examiner*—T. G. Graveline
*Attorney, Agent, or Firm*—Sixbey, Friedman & Leedom

[57] ABSTRACT

Athletic shoe sole having cleats with exchangeable gripping elements designed such that the threaded mounting studs for gripping elements are firmly anchored to the sole, and that the associated caps of the gripping elements can be detached therefrom without damage or destruction to the threaded studs. This is achieved in that each threaded stud (2) and the screw-on cap **(5, 5*a*) is in the shape of a cone whose broad base faces the shoe sole (1). The thread is a single or multiple thread (4) having only partial turns of screw threads. Finally, run-on surfaces (12, 13) effective during screw-on of lock elements (10, 11) of the cap are less inclined relative to the plane of the sole (1) than the flank surfaces that act as locking surfaces (14, 15)** which are also inclined.

20 Claims, 3 Drawing Figures

ATHLETIC SHOE SOLE WITH CLEATS HAVING THREADED EXCHANGEABLE GRIPPING ELEMENTS

BACKGROUND AND SUMMARY OF THE INVENTION

The present invention relates to an outer sole for an athletic shoe of the type having cleats with exchangeable gripping elements that are screwed onto sole-mounted threaded studs.

An athletic shoe having a sole of this kind is described in U.S. Pat. No. 2,302,471, where a kind of flat headed screw is inserted through the shoe sole from the inside, and a washer and locking disk are secured by a nut onto the exteriorly projecting threaded shaft. Moreover, a cone-shaped gripping element, having teeth at its base, is screwed onto the projecting threaded shaft. The teeth at the base of the gripping element form a locking engagement, when screwed onto the shoe sole, with the grip members punched out from the washer. To ensure locking action, the washer has exteriorly toothed ring elements that cut into the shoe sole. A threaded sleeve is molded into the bore of the cap, which consists of deformable material, like rubber, to ensure firm anchoring thereof.

However, this known construction has several disadvantages. Firstly, the continuous flat headed screw causes considerable weakening of the sole, which may tear at the bore edges when frequently deformed. A similar effect is caused by the sharp toothed ring elements cutting into the sole. Another drawback of the known arrangement is the necessity of the special threaded sleeve in the cap.

A similar arrangement of gripping elements is disclosed in U.S. Pat. No. 3,054,197, as can be seen from the drawings of this patent.

German O. S. No. 2,542,116 shows a grip element in the form of a conventional screw-in cleat, which additionally can be screwed onto a shallow threaded study by way of an interior thread. This threaded stud has cylindrical shape. As the gripping elements, however, advantageously should be cone shaped, this creates a thin area in the vicinity of the threaded stud in the cleat wall, which may result in breakage of the cleat due to cold weather and correspondingly stiff material.

It is the objective of the present invention to provide an outer sole for an athletic shoe having cleats with exchangeable gripping elements of the foregoing kind that are designed for easy and cost-effective manufacture, yet a premature tearing, breaking, or breaking away of the sole is prevented, while at the same time, the caps can be removed from the studs without damaging or destroying them.

Furthermore, a cone shaped stud and snap-on cap are described in German Patent GM No. 1,888,123. However, the stud and cap are nailed on, and a screw-lock engagement is not featured.

This objective is achieved by employing the special features of the invention wherein a cone shaped threaded stud projects from a ground contacting surface of the sole and a hollow, tapered screw-on cap is threadingly engageable thereon with the broad base of the cap facing the sole, wherein the threading of the stud and the cap extends for less than a full turn and wherein the cap is provided with locking elements that interact with locking elements of the sole, said locking elements forming a ratchet-like locking assembly and having run-on surfaces that are less inclined relative to a plane of a bottom surface of the sole than inclined locking surfaces of the locking elements.

The present invention provides large area contact between the threaded stud and the cap, whereby the use of special threaded sleeves is not necessary. The partial screw threads permit a quick fastening and removal with low rotational effort of the cap, and the special inclined configuration of the teeth permits a soft screwing on, while the screwing off action necessitates high rotational moment, without, however, causing any marring or damage of the locking elements. When the threaded studs are molded to the sole, only the caps, without additional components, are to be screwed on.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Numeral 1 designates a shoe sole, particularly an outsole of an athletic shoe, e.g., football, hockey or baseball shoe. Generally, this outsole consists of a single component made of injection molded or cast synthetic material, like polyurethane, polyethylene, polyamide, hexamethylenediamine adipic acid polycondensate or similar material, and extends over the entire bottom of a shoe, i.e., from the toe to the heel of the shoe. The heel and sole portions, may, however, be two separate parts. The shoe sole or the sole portion and the heel are provided with studs 2 which, preferably, form a single structural element therewith. Alternatively, the studs may consist of individual studs, possible with stamped flanges, which studs can be inserted, snap locked, or advantageously, molded into the sole or into the sole member and heel.

Figure 1:
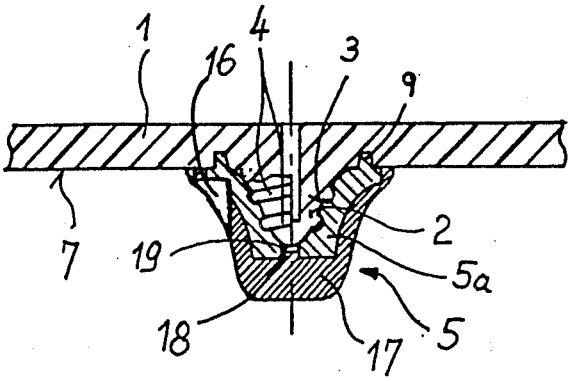
FIG. 1 is a vertical cross sectional view of a portion of a sole in accordance with the present invention, part of a stud thereof being shown in elevation.
Figure 1A:
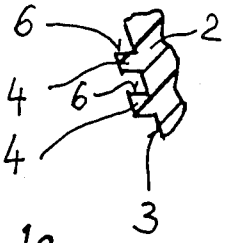
FIG. 1*a* is an enlarged cross section of a threaded portion of a stud.

In accordance with the invention, a thread 4, specifically a multiple thread having, preferably, a short or steep thread course, which consists of only partial turns of screw threads, is molded on the outer surface 3 of stud 2. Preferably, the partial screw thread turns constitute approximately 25% to 50% of a complete thread turn, so that the caps (cap members which will be subsequently described) can engage the short or steep threads in the manner of a quick action lock. Caps 5 or cap members 5*a* are screwed onto stud 2 with a corresponding counter thread. Threads 4, preferably, are threads of rectangular or trapezoidal shape. Advantageously, the flanks 6 of threads 4, facing in the direction of shoe sole 1, are parallel, or nearly parallel, to the plane of the bottom surface 7 of sole 1 to obtain a high degree of screw-on stability (FIG. 1*a*).

Figure 2:
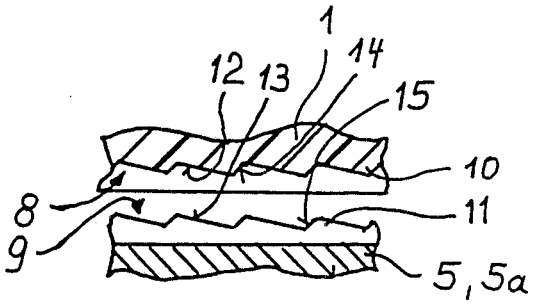
FIG. 2 is an exploded view depicting interacting contact areas of sole or stud and cap or cap member.

Advantageously, interacting areas are provided at shoe sole 1 and at caps 5 or cap members 5*a*, respectively, (FIG. 2) to prevent loosening of the screw engagement during athletic activity. This is achieved, in accordance with the illustrated embodiment, by lock elements 10, 11 (FIG. 2), provided on the facing contact surfaces, preferably in the shape of saw teeth, lock elements 10 being located within an annular recess 8 in the bottom surface 7 of sole 1 and lock elements 11 being formed on an annular flange 9 that is received within recess 8. The tooth flanks serving as run-on surfaces 12, 13 during screw on are less inclined relative to bottom surface 7 than the tooth flanks 14, 15 serving as locking surfaces. By this arrangement a ratchet-like effect is provided whereby the torsional moment for the screw-on engagement of the cap 5, cap member 5*a* is reduced, but the torsional force required for disengagement is increased so as to practically eliminate self-disengagement.

In order to facilitate screw-on and screw-off action, cap 5 or cap member 5*a* have inset areas to receive a tool, e.g., cut-outs 16, multiple exterior surfaces, or shoulders.

Cap 5, as a single homogeneous component, may consist of an abrasion resistant synthetic material, like hard PVC, hard polyurethane, polyethylene, polycarbonate, or similar material, or may consist of a metal like aluminum, copper, brass, bronze, or steel, or it may be made of a ceramic, like steatite, aluminum, oxide, zirconium dioxide, or corundum, that, where appropriate, is combined with organic or inorganic binders. The cap may, furthermore, be comprised of textile, glass-metal or reinforced coal-fiber synthetic material, and/or abrasion resistant particles of metal or ceramic may be admixed into a synthetic plastic material or may be embedded into the stress areas, preferably by pressing-in.

However, as depicted in the drawing, cap 5 may be comprised of a cap member 5*a* having a wear-resistant grip element 17 mounted thereover. Advantageously, stud 2 and cap member 5*a* are designed as truncated cones, in which case, grip element 17 has the shape of a disk secured on the truncated cone-shaped cap member 5*a*, or may have the shape of an overlapping bell. Alternatively, particularly, when studs 2 are cylindrical, grip element 17 may have a sleeve-shaped design, in which case, cap members 5*a* and grip element 17 may consist of the same material as cap 5, namely of a single homogeneous material. Appropriately, however, cap member 5*a* is somewhat softer, and specifically may consist of synthetic material which renders it somewhat resilient, facilitating an easier friction fit.

Cap member 5*a* and grip element 17 are interconnected by way of lock and/or centering elements, e.g., projection 18 and bore 19, and may, additionally, be glued. Alternatively, it is possible to directly mold grip element 17 to cap 5*a* when fashioning cap member 5*a*.

While we have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

We claim:

1. An outer sole for an athletic shoe of the type having cleats with exchangeable grip elements, wherein a cone-shaped threaded stud projects from a bottom surface of the sole and a hollow, tapered screw-on cap is threadingly engageable thereon with a broad base of the cap facing the sole wherein the ground-contacting surface of the sole is provided with an annular recess surrounding the threaded stud, wherein a sole-facing side of said broad base of the cap is provided with an annular flange that is sized, shaped and positioned for reception within said annular recess when said cap is screwed onto said threaded stud, and wherein a ratchet-like locking assembly is provided for securing the cap upon the threaded stud, said locking assembly comprising a first set of locking elements provided within said annular recess which interact with a second set of locking elements formed on said annular flange, the locking elements of said sets of locking elements having run-on surfaces and locking surfaces, said run-on surfaces being less inclined relative to a plane of said bottom surface of the sole than the locking surface.

2. An outer sole for an athletic shoe according to claim 1, wherein the threaded stud is molded to the sole so as to form a structural unit therewith.

3. An outer sole for an athletic shoe according to claim 1, wherein said cap is comprised of a cap member for threadingly engaging said stud and a grip element mounted on said cap member at the grip area of the cap.

4. An outer sole for an athletic shoe according to claim 1, wherein the threading of the stud and the cap are multiple threads that extend for less than a full turn.

5. An outer sole for an athletic shoe according to claim 1, wherein the extent of the threading is approximately 25% to 50% of a single complete thread turn.

6. An outer sole for an athletic shoe according to claim 5, wherein the threading has a flank facing the shoe sole which extends substantially parallel to said plane of the bottom surface of the sole.

7. An outer sole for an athletic shoe according to claim 6, wherein said threading has a generally rectangular cross section.

8. An outer sole for an athletic shoe according to claim 1, wherein the threading has a flank facing the shoe sole which extends substantially parallel to said plane of the bottom surface of the sole.

9. An outer sole for an athletic shoe according to claim 8, wherein said threading has a generally rectangular cross section.

10. An outer sole for an athletic shoe according to claim 8, wherein at least a portion of the caps consist of a resilient synthetic material, and the grip area of the cap is reinforced with an abrasion-resistant material.

11. An outer sole for an athletic shoe according to claim 10, wherein said cap is comprised of a cap member for threadingly engaging said stud and a grip element mounted on said cap member at the grip area of the cap.

12. An outer sole for an athletic shoe according to claim 11, wherein the grip element is a bell-shaped dome overlying the cap member.

13. An outer sole for an athletic shoe according to claim 1, wherein at least a portion of the caps consist of a resilient synthetic material, and the grip area of the cap is reinforced with an abrasion-resistant material.

14. An outer sole for an athletic shoe according to claim 3, wherein said cap is comprised of a cap member for threadingly engaging said stud and a grip element mounted on said cap member at the grip area of the cap.

15. An outer sole for an athletic shoe according to claim 14, wherein the threaded stud is molded to the sole so as to form a structural unit therewith.

16. An outer sole for an athletic shoe according to claim 14, wherein the grip element is a bell-shaped dome overlying the cap member.

17. An outer sole for an athletic shoe according to claim 16, wherein the cap members are made of a metal from the group consisting of aluminum, copper, brass, bronze, steel, cast zinc and similar metals.

18. An outer sole for an athletic shoe according to claim 16, wherein the grip element is formed of a metal from the group consisting of aluminum, copper, brass, bronze, steel and cast zinc.

19. An outer sole for an athletic shoe according to claim 16, wherein the sole and at least the cap members of the cap are formed of hard resilient, synthetic material from the group consisting of polyurethane, polyethylene, polyamide, polycarbonate and similar materials.

20. An outer sole for an athletic shoe according to claim 19, wherein the grip element is formed of a ceramic material from the group consisting of steatite, aluminum oxide, zirconium dioxide, corundum and mixtures of such ceramic materials with a ceramic binder.

* * * * *